US005412966A

United States Patent [19]

Neese et al.

[11] Patent Number: 5,412,966

[45] Date of Patent: May 9, 1995

[54] PUSH-PULL PICKLE LINE

[75] Inventors: Edward D. Neese, Sewickley; Matthew W. Botsford, Jr., Pittsburgh, both of Pa.

[73] Assignee: WorldClass Industries, Inc., Ambridge, Pa.

[21] Appl. No.: 93,257

[22] Filed: Jul. 16, 1993

[51] Int. Cl.[6] ..... B21B 45/06; B08B 3/08

[52] U.S. Cl. ..... 72/37; 72/39; 72/250; 134/64 R; 134/113

[58] Field of Search ..... 72/37, 38, 39, 40, 199, 72/250, 426, 245, 247, 241.8; 29/DIG. 32; 134/3, 15, 16, 113, 64 R, 122 R; 193/35 SS; 198/339.1; 242/78.1, 79

[56] References Cited

U.S. PATENT DOCUMENTS

| | | | |
|---|---|---|---|
| Re. 28,494 | 7/1975 | Rowe | 148/610 |
| 2,650,888 | 9/1953 | Pottberg | 134/16 |
| 3,186,655 | 6/1965 | Huffington et al. | 242/79 |
| 3,351,299 | 11/1967 | Fehr | 242/79 |
| 3,442,109 | 5/1969 | Diolot | 72/241.8 |
| 3,584,853 | 6/1971 | Munson | 72/15 |
| 3,727,820 | 4/1973 | Braun | 226/113 |
| 3,877,270 | 4/1975 | Marten | 72/245 |
| 3,918,282 | 11/1975 | Eibe | 72/228 |
| 4,152,919 | 5/1979 | Bald et al. | 242/79 |
| 4,361,444 | 11/1982 | McClanahan et al. | 134/3 |
| 4,548,063 | 10/1985 | Cox | 72/16 |
| 4,552,299 | 11/1985 | Sendzimir | 228/5.7 |
| 4,663,986 | 5/1987 | Yamamoto et al. | 242/78.1 |
| 4,807,653 | 2/1989 | Cipriano et al. | 134/64 |
| 4,872,245 | 10/1989 | Kawasaki et al. | 134/63 |
| 4,885,041 | 12/1989 | Den Hartog et al. | 148/625 |
| 4,913,748 | 4/1990 | Sellitto et al. | 148/601 |
| 4,996,998 | 3/1991 | Seiz et al. | 134/113 |
| 5,009,396 | 4/1991 | Den Hartog et al. | 266/108 |
| 5,282,485 | 2/1994 | Hirai et al. | 134/64 R |

FOREIGN PATENT DOCUMENTS

| | | | |
|---|---|---|---|
| 0089318 | 7/1981 | Japan | 72/39 |
| 0047519 | 4/1982 | Japan | 72/39 |

*Primary Examiner*—Lowell A. Larson
*Assistant Examiner*—Thomas C. Schoeffler
*Attorney, Agent, or Firm*—Reed Smith Shaw & McClay

[57] ABSTRACT

A semi-continuous "push-pull" pickle line for removing oxides from hot-rolled steel strip. In addition to other value added features, a treatment portion of the pickle line includes: (1) a two-high temper mill operable to break scale on the strip as well as elongate, shape correct and controllably reduce the gauge of the strip; (2) a pickling zone including at least one V-shaped, shallow-path pickling tank within which a plurality of sparging ports dispense substantially laminar flows of acid solution toward the bottom surface of the strip as it passes through the pickling tank; and (3) a displaceable inspection table desirably cooperating with lights and mirrors to permit simultaneous inspection of the top and bottom surfaces of the steel after pickling.

35 Claims, 12 Drawing Sheets

PUSH-PULL PICKLE LINE

FIELD OF THE INVENTION

The present invention relates in general to steel treatment processes and, in particular, to apparatus and methods for semi-continuously pickling hot-rolled steel strip.

BACKGROUND OF THE INVENTION

The presence of oxide (scale) on the surface of steel strip, sheet, or breakdowns, is objectionable when such materials are to be further processed. For example, the oxide must be removed and a clean surface provided if satisfactory results are to be obtained from the hot-rolled sheet or strip in any operation involving deformation of the material. If the sheet is for drawing applications, removal of the oxide is essential, and its presence on the steel surface tends to shorten die life, cause irregular drawing conditions and destroy surface smoothness of the finished product. Oxide removal is also necessary to permit proper alloying or adherence of metallic coatings and satisfactory adherence when a non-metallic coating or paint is used.

In the production of cold-reduced steel sheet and strip, it is necessary that the oxide resulting during hot rolling the steel slab to breakdown form be completely removed before cold reduction to prevent lack of uniformity and eliminate surface irregularities.

The term "oxide" as used here refers generally to the chemical compounds of iron and oxygen formed on the surface of the steel by exposure to air while the metal is at an elevated temperature. "Scale" is specifically the oxidized surface of steel produced during hot working of steel. Hence, the oxide produced on steel surfaces in hot-rolling processes is known as mill scale. Chemical compounds thus formed are iron oxides FeO, $Fe_2O_3$ and $Fe_3O_4$.

Pickling is the process of chemically removing oxides and scale from the surface of a metal by the action of water solutions of inorganic acids. Considerable variation in type of pickling solution, operation and equipment is found in the industry. Among the types of pickling equipment may be mentioned the batch picklers, modified batch, non-or semi-continuous and continuous picklers.

The reaction occurring when steel or iron materials are immersed in dilute inorganic acid solutions includes the solution of metal as a salt of the acid and the evolution of hydrogen. Steel pickled in dilute hydrochloric acid and sulfuric-acid solutions is an example of this reaction, with the end products of reaction being, respectively, ferrous chloride and hydrogen and ferrous sulfate and hydrogen. Adherent films of oxides are undermined by the acid attack upon the scale on the base metal.

The rate of pickling is affected by numerous variables, including the steel-based constituents and type and adherence of oxide to be removed. Solution temperature and concentration, ferrous chloride or ferrous sulfate concentration, agitation, time of immersion and presence of inhibitors influence the rate of acid attack. Because of factors including pickling speed and efficiency, as well as reduced attack on the base metal, hydrochloric acid has effectively displaced sulfuric acid as the acid of choice in industrial pickling operations. While the rate of pickling increases in direct proportion to the concentration of the acid, the influence of temperature is much more pronounced. For example, in 15 percent sulfuric acid an increase in temperature over the range 70° F. to 210° F. doubles the pickling rate for each rise of 15° or 20° F. in temperature. Rate of solution of iron at 180° F. is about five times the rate at room temperature. Certain metals, such as copper, chromium and nickel, retard the rate of pickling when they occur in the steel base, since the scale bearing these alloying metals inhibits acid attack. Silicon and aluminum form refractory-type oxides, which in turn lower the solubility rate of the oxide in the acid.

With the advent of continuous cold-reduction mills, it was necessary to design and develop suitable equipment to remove the oxides resulting from the oxides resulting from the continuous hot-rolling operation and prepare the hot-rolled breakdowns for cold reduction in coil form. This operation is typically performed in either a continuous or semi-continuous (push-pull) pickling line. The primary function of a continuous and semi-continuous pickling line, as of other pickling processes, is the removal of oxide from the steel surface. This serves to promote maximum reduction with a minimum of power to assure good roll life in the cold-reduction mills and to secure the increased surface density possible with cold work. The primary differences between a continuous pickle line and a non-or semi-continuous pickle line is that in a continuous line the tail of one coil is welded to the head of the next coil so that the strip is always in tension. In addition, continuous pickle lines generally require looping pits for providing strip storage space when brief delays arise at the strip charging end and for permitting a uniform rate of travel through the pickling tanks. An advantage of semi-continuous picklers is that they readily accommodate coil-to-coil changes in strip width and gauge with minimal down time.

The thickness of the oxide varies considerably on steel rolled on the hot-strip mill. Loose coiling permits greater atmospheric penetration into the wraps, with corresponding heavier oxide formation on the edge areas. Flexing of the steel in passing through the pickling line uncoiler and temper mill breaks this scale or oxide film and permits more rapid attack by the acid bath.

The non-continuous and continuous pickler has other advantages or supplementary functions. The product of the hot-strip mill is subject to fluting (formation of creases when the steel is bent or otherwise deformed) due to lack of springiness. Non-continuous and continuous pickling lines usually are equipped with suitable apparatus for cold working the material so that severe local strains are eliminated and fluting largely is prevented. The conventional pickling line permits inspection of the upper surface of the steel for defects and suitability for the next operation, as well as oiling of the steel as a protection against rusting and as an aid to cold reduction.

At the coil entry end of a typical semi-continuous or a continuous pickling line are facilities for handling and charging coiled product into the line. These usually consist of conveyors on which the coils are placed in proper sequence by overhead cranes, upenders in cases where the coil is delivered with the axis vertical, and a motor-driven integrated buggy and hoist for placing the coil in the uncoiling or pay-off equipment. The primary cold-working equipment called a "processor," or "flattener," integral with the uncoiling equipment, consists of a mandrel on which the coil is placed, a hold-down roll, and a series of smaller diameter rolls. After the coil is charged on the mandrel and the lead-end entered into the small diameter rolls, the hold-down roll is brought down and pressure applied to the material. This action alternatively flexes the steel around the rolls, thus effectively "breaking" the surface scale into numerous fine cracks, and increasing the available sub-oxide area for pickle attack. This flexing also cold works the steel enough to eliminate, in large part, the fluting tendencies of the hot-rolled steel. The group of small driven rolls immediately following the hold-down or breaker roll applies tension to the steel and also serves to straighten and flatten it. A stationary shear is located after the processor for the cropping and squaring of the coil ends.

In some pickling lines, an auxiliary or secondary scalebreaker is provided to break the scale even further than was achieved in the processor at the entry end, and thus increase the speed at which the line can be operated and still produce satisfactorily pickled strip. The secondary scalebreaker may be a machine similar to the entry-end processor, or it may be a two-high temper mill preceded and followed by a tension bridle at the entry and exit sides of the mill. Use of a two-high temper mill, for example, may result in extension of the strip on the order of 3 percent and increased is hardness 3 to 5 points on the Rockwell B scale.

The pickling zone usually consists of several individual acid-proof tanks located in series, comprising an effective immersion length of about 250 to 300 feet. While many lines have from three to five tanks, each about 70 to 80 feet long, some lines have only one long tank, divided by weirs into four or five sections. The strip is completely submerged under several inches of liquid acid bath as it travels through the tank or series of tanks forming the pickling zone. Automatic acid controls are available which monitor the HCl content in one or more tank sections of the line and automatically add acid to maintain a preset concentration. In a typical line the acid is added in the third and fourth tank section. The pickling solution then cascades over the top of the strip and counter to strip travel through shallow channels cut in the weirs between tank sections. The tanks are about four feet in depth and weir heights are decreased about an inch per weir from the exit entry end of the tanks. In a typical four tank line, weir heights would be on the order of 40, 39 and 38 inches in height from the exit to the entry end of the pickling tanks.

In hot-rolling operations, the steel strip is usually water cooled after hot-rolling by exposing the top surface of the strip to a stream or spray of water. The cooling water tends to pool on the top surface of the strip, thereby cooling the top surface at a faster rate than the bottom surface. And, since the rate of oxidation of steel is a proportional function of both time and temperature, scale formation is virtually always thicker on the bottom surface of the hot-rolled strip.

Consequently, in deep bath pickling tanks heretofore known in the art wherein the pickle liquor is introduced above rather than beneath the strip, the acid attack on the relatively thicker scale at the strip bottom surface is essentially passive in nature, hence resulting in slower than desirable line speeds in order to remove the scale from the bottom surface.

Following the acid tanks in a conventional pickle line are rinsing tanks consisting of cold-water spray rinse and, occasionally, a hot-water tank. The cold water rinses the acid carry-over from the steel. The hot-water rinse is a tank with an effective product immersion length of 15 to 20 feet. This tank completes the rinsing and by warming the steel, promotes flash drying prior to entering the succeeding set of pinch rolls. Situated between the final rinse tank and the pinch rolls are one, two or three banks of hot-air dryers operating at low pressures. Pinch rolls at the exit end of the pickling tanks control the speed of product travel and, in conjunction with the pinch rolls which provide back tension at the entry end of the line, help to maintain the proper loops in the tanks.

The delivery or exit end of the pickling line commonly has, in the order listed, a looping pit, pinch rolls, shear, oiler, recoiler and suitable supplementary equipment for conveying the finished product from the line. The pinch rolls preceding the shear are located so that product delivery to the shear is facilitated. Stitches, if present, are removed at this point, as well as short sections which inspection has shown to be inferior quality. Some lines are provided also with rotary side trimmers at the entry end or, more commonly, at the delivery end.

Inspection of the raw pickled product is carried on continuously at the exit end of the pickling lines. Each coil is inspected for surface and edge quality, width and gauge. Some of the defects commonly causing rejection or diversion are as follows: slivers, cracked edges, laminations, off-gauge, off-width, roll marks underpickling, overpickling, handling damage and pitting. However, no systems known to the inventor enable simultaneous inspection of both surfaces the strip subsequent to the pickling operation.

Underpickling results when the steel has not had sufficient time in the pickling tanks to become free of adherent scale and occurs when acid concentration, solution temperatures and line speed are not balanced properly. Variations in the oxide and composition of the steel are also factors in underpickled product, as well as such factors as coiling temperature of the hot-strip mill and inadequate amount of cold working through the processor. Overpickling results from the line delays which permit sections of the steel to remain in the acid too long. The presence of an inhibitor reduces iron loss, but when an inhibitor is not used, iron loss during a short delay period appreciably reduces thickness of the steel and raises the hazard of hydrogen embrittlement. Pitting is related to overpickling, the presence on nonmetallic inclusions near the steel surface and to rolled-in scale, slag or a refractory substance. While overpickling is not common in continuous or semi-continuous pickling operations, its occurrence does have a very serious effect on cold-reduction performance and surface appearance of the finished product. Furthermore, product damage from handling or improper equipment adjustment can render the steel unsuitable for further processing.

Prior to recoiling, the pickled steel passes between a set of oiling rolls which cover both surfaces with a small amount of oil. The type of oil used to lubricate the steel, and protect it from rusting during storage and from scratching during handling, is determined by the type of lubricating system on the cold-reduction mill unit. Hence, palm oil diluted with light mineral oil, is applied to the steel at the pickling line when a straight palm oil or a solution contained palm oil is used on the cold-reduction mill. Finally, the pickled and oiled product is recoiled on a conventional up-type or down-type coiler.

Notwithstanding their efficacy in pickling steel strip, such systems are highly complex in construction, undesirably dilatory in oxide removal, and consume copious quantities of materials and energy in operation. Moreover, conventional pickling systems do not permit simultaneous quality inspection of both surfaces of the strip following pickling.

An advantage exists, therefore, for a pickle line for steel strip of relatively compact layout and simplified and efficient operation. An additional advantage exists for a steel strip pickling line which affords simultaneous visual quality inspection of both strip surfaces after the strip has been pickled.

SUMMARY OF THE INVENTION

The present invention provides a non- or semi-continuous "push-pull pickle line" for removing oxides from the surface of hot-rolled steel strip and includes a coil entry portion, a strip treatment portion and a coil delivery or exit portion. The coil entry portion comprises a first conveyor for transporting hot-rolled strip coils to a coil preparation station and to a coil pusher which, in turn, feeds the coils to an uncoiler, the initial component of the strip treatment portion. The strip is uncoiled by the uncoiler and passed through a motor-driven, multiple-roll coil peeler or flattener which flexes the strip to form cracks in the surface scale that facilitate acid attack at the downstream pickling zone. After passing the coil peeler the strip enters a two-high temper mill whereat the scale is further broken and where the shape of the strip may be corrected, the strip may be elongated and its gauge reduced. Desirably, the temper mill is equipped with an x-ray or similar testing means to determine whether the strip is of suitable quality for further treatment. The strip is then engaged by a first pinch roll operable to deflect the strip either to a cleaning section, or to a recoiler (in the event the strip is found to be unfit for pickling). Additional equipment, e.g., a strip guide, a thickness gauge and/or a crop shear and scrap cart, may be situated between the first pinch roll and the cleaning station.

Within the cleaning station the strip is sprayed with a mist of cleaning solution such as a caustic 10% KOH or NaOH solution which is dispensed from a plurality of spray nozzles serially arranged above and below the strip in the direction of strip travel. Following the cleaning station the strip passes through a series of shallow V-shaped pickle tanks within which the strip is treated on its bottom surface by a series of laminar flow jets producing sparging by dispensing dilute acid solution. The laminar flow of the acid coupled with the velocity of the moving strip cooperate to aggressively scrub the strip bottom surface of oxides and related scale. Thus, oxides can be removed at cost effective line speeds from both the bottom and the top surfaces of strips having difficult steel chemistries or high cooling temperature at the hot strip mill with respect to oxide formation and retention.

Upon exiting the pickle tanks, the strip is rinsed at a rinsing station then dried with hot air and coated with a dry lubricant. Thereafter, a second pinch roll delivers the strip to an exit shear which cuts the strip to a predetermined length with the scrap metal from the shearing being deposited in a scrap cart. Beyond the exit shear lies a strip guide, a slitter pinch roll and a trimmer/slitter to cut the strip into accurate and uniform width while also enabling the strip, if desired, to be cut into two or more narrower strips suitable for coiling.

A run out table follows the trimmer/slitter. Unlike run out tables heretofore known in the art that enable just the top surface of the strip to be quality inspected after pickling, the run out table section includes an inspection table which may be lowered as the strip passes over a battery of lights for illuminating and mirrors for reflecting the strip bottom surface. With this construction, the novel run out table permits both strip surfaces to be simultaneously visually observed and quality inspected by the line operator/inspector as the strip passes the operating platform.

Upon traversing the run out table, a tension device urges the strip into an oiler adapted to coat the strip with an oil based lubricant to protect the strip from oxidation during storage. The strip is then delivered from the oiler via a deflector pinch roll to a recoiler, which serves as both the final component of the strip treatment portion as well as the initial component of the delivery portion of the line.

The delivery portion includes a second conveyor and a turnstile in addition to the recoiler, which, in the preferred embodiment, is a dual mandrel turret recoiler. The dual mandrel turret recoiler is capable of recoiling a first pickled strip about one mandrel thereof, then rotating the strip coil 180° to deliver the coil to a discharge position while presenting the other mandrel of the recoiler into position for coiling a second length of pickled strip. The second conveyor then transports the first coil or pickled strip from the discharge position to a multiple (preferably four) arm turnstile. The turnstile receives the coil and is positionable to enable the coil to be removed by a grapple or hook of a suitable coil lifting device which may place the coil at a selected site. The operations of the dual mandrel turret recoiler, second conveyor and turnstile are coordinated with one another, as well as the coil entry and treatment portions of the pickle line, such that delivery efficiency of the pickled coils may be optimized.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings, wherein.

DETAILED DESCRIPTION OF THE INVENTION

Figure 1:
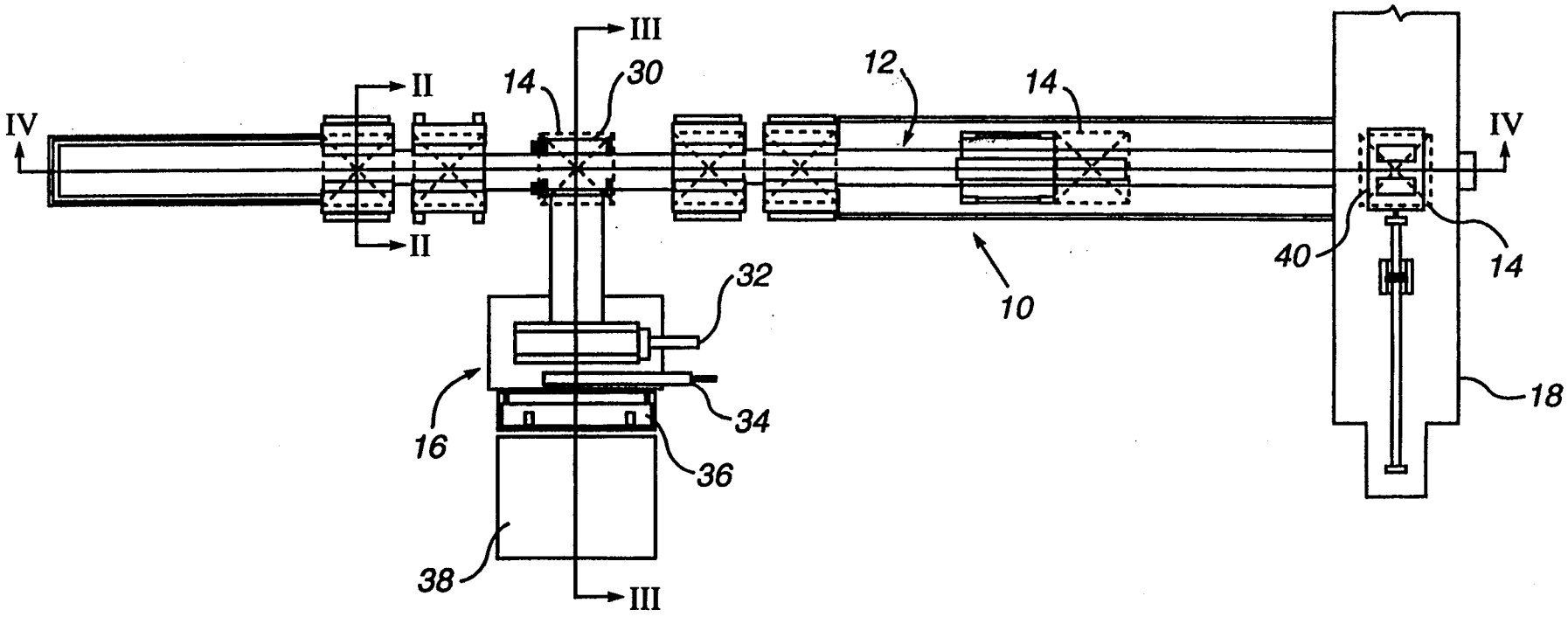
FIG. 1 is a plan view of the coil entry portion of a pickle line constructed in accordance with the present invention.
Figure 4:
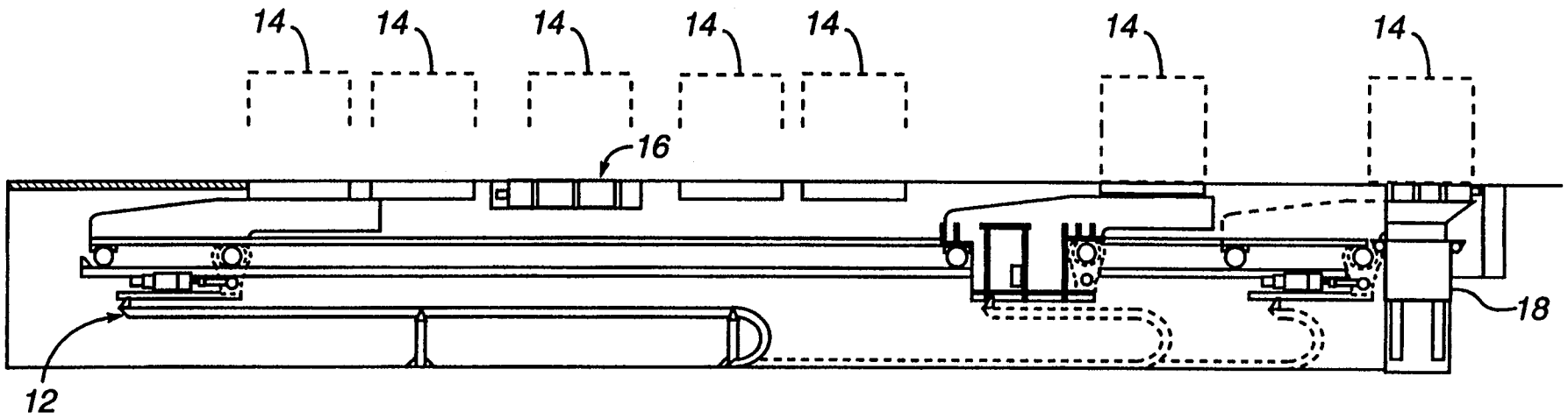
FIG. 4 is a sectional view of the coil entry portion taken along line IV—IV of FIG. 1.

There is generally indicated at 10 in FIGS. 1 and 4 a coil entry portion of a steel strip pickling line constructed according to a presently preferred embodiment of the instant invention. Coil entry portion 10 includes a first conveyor 12 for transporting hot-rolled strip coils 14 to a coil preparation station 16 and to a coil car system 18. The coil car system operates to move coils 14 from the first conveyor 12 to an uncoiler station of a later-described strip treatment portion of the pickle line.

Figure 2:
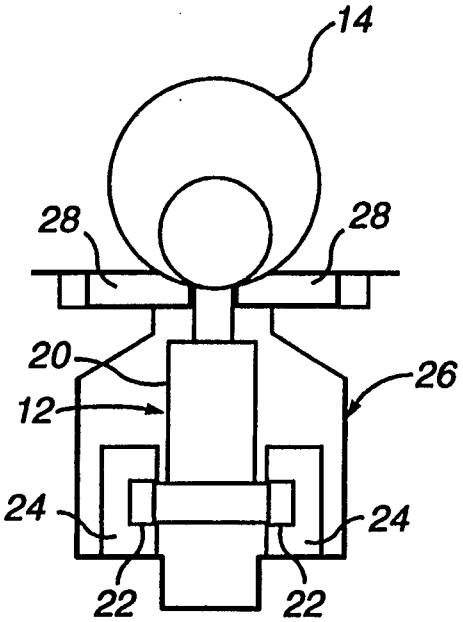
FIG. 2 is sectional view of the coil entry portion taken along line II—II of FIG. 1.

As is most clearly depicted in FIGS. 2 and 4, the first conveyor 12 comprises a motorized, reciprocable carriage 20 rollingly supported at opposite sides thereof by wheels 22 which travel in spaced, parallel rails 24 provided in a subterranean conveyor passageway 26. Situated atop the carriage 20 is a pair of coil saddles 28 by which the carriage supports the coils during transport. Upon loading of a coil 14 on saddles 28, the coil is first delivered by carriage 20 to the coil preparation station 16.

Figure 3:
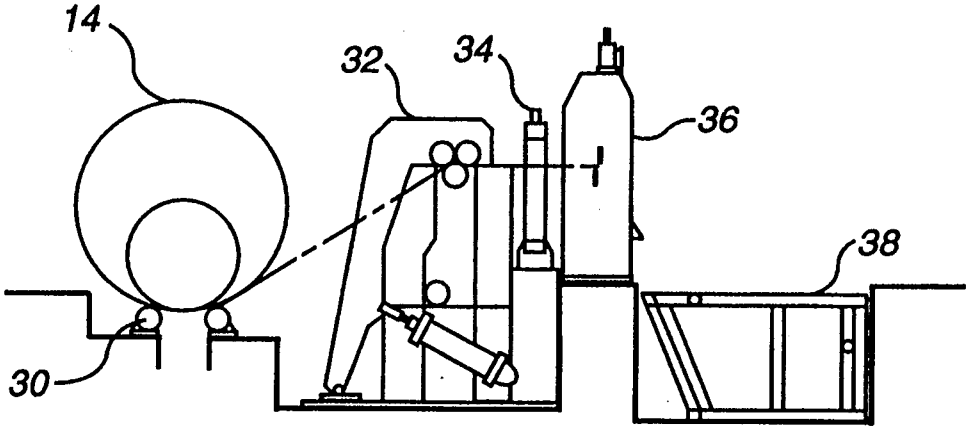
FIG. 3 is a sectional view of the coil entry portion taken along line III—III of FIG. 1.
Figure 5A:
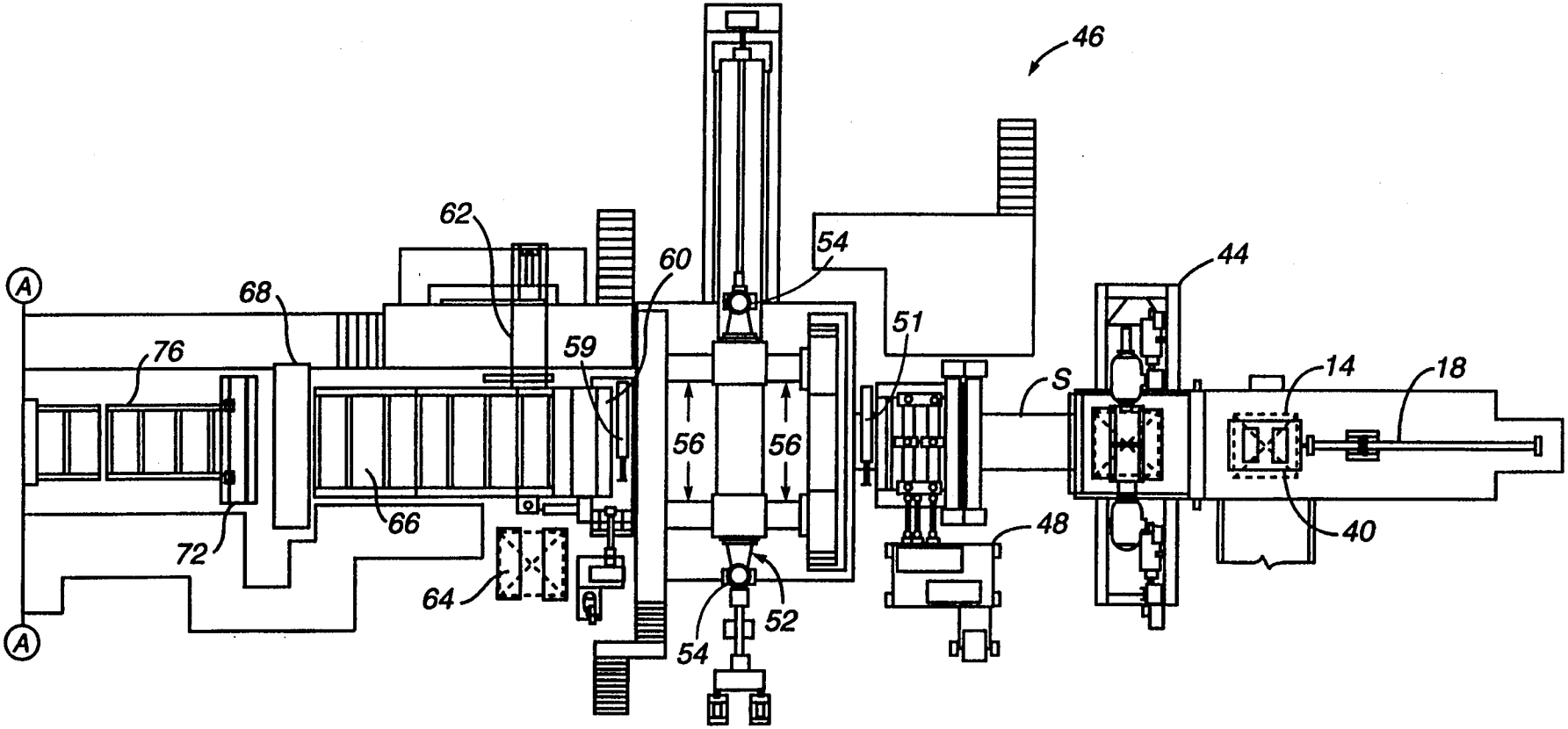
FIGS. 5A, 5B, 5C, 5D and 5E are serial plan views of the strip treatment portion of a pickle line constructed according to the present invention.
Figure 6E:
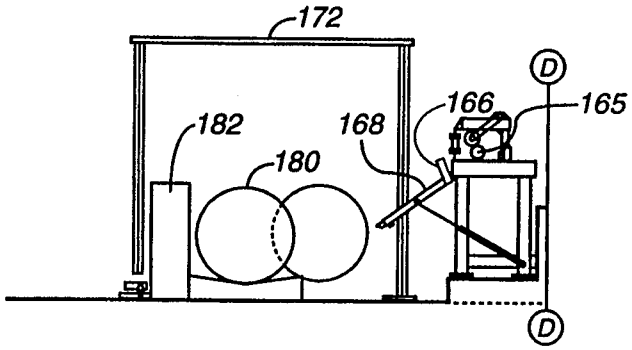
FIGS. 6A, 6B, 6C, 6D and 6E are serial elevation views corresponding to FIGS. 5A through 5E of the centerline of the strip treatment portion.
Figure 6A:
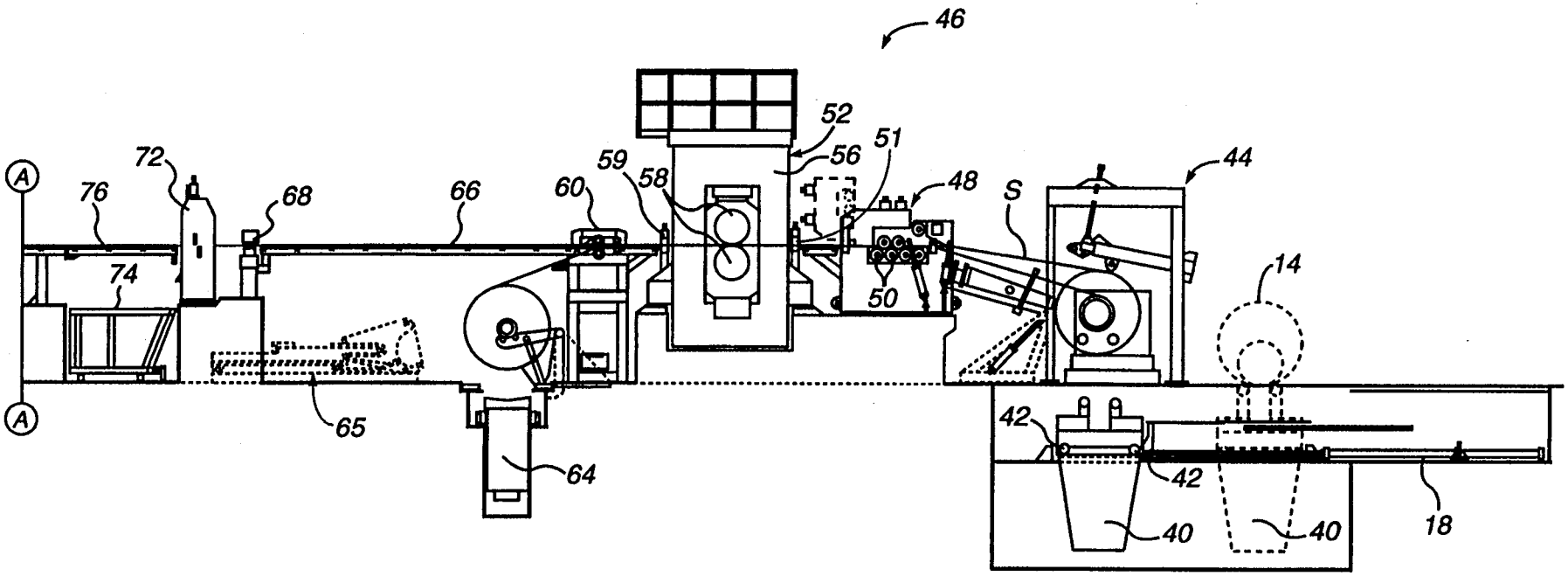

The coil preparation station, as shown in FIGS. 1 and 3, includes a blocker roll 30, a coil set removal unit 32, x-ray or equivalent monitoring equipment 34 for examining steel characteristics such as gauge, surface quality, and the like, a crop shear 36 and a scrap box 38. Along with thickness measurement, the coil preparation station, by virtue of the crop shear 36, enables cutting of the strip to an approximate preliminary length as well as squaring of the leading strip end to facilitate its passage through the downstream strip treatment equipment. Any excess steel cut by the crop share is deposited in the scrap box 38. Once adequately prepared, the lead end of the strip is temporarily secured to the coil whereupon the coil is delivered by the carriage 20 to an entry uncoiler car 40 (FIGS. 5A and 6A). Generally, the dimensions of steel strip subjected to processing by the pickle line of the instant invention will range in gauge from about 0.060 to about 0.500 inches in thickness and about 48 to about 72 inches in width, although strip of somewhat greater or lesser gauge and/or width may be successfully processed.

The entry uncoiler car is mounted on wheels 42 and travels transversely to the first conveyor 12. The coil car system 18 engages the entry uncoiler car and moves the car to an entry uncoiler 44, the initial component of a strip treatment portion 46 of the steel strip pickling line. As is common, the uncoiler 44 is a motor driven mechanism including a payoff snubber and breaker roll by which the leading strip end is unwound from the coil 14 and charged into a coil peeler or flattener 48. The flattener is also a motorized device and comprises a series of small diameter driven rolls 50 (FIG. 6A) situated both above and beneath the strip and between which the strip (which is designated by the letter "S") passes. Although the axes of rotation of the upper and lower rolls 50 are parallel to one another and extend generally normal to the strip travel direction, the upper rolls are horizontally offset relative to the lower rolls whereby the strip is caused to flex upwardly and downwardly as it passes the flattener rolls. This flexure forms cracks in the strip's surface scale that facilitate acid attack at the downstream pickling zone to be described in detail hereinafter.

The flattener then propels the strip past an x-ray thickness gauge 51 (or similar gauge) before feeding it to a two-high temper mill 52 manufactured by the Mill Equipment Company (hereinafter "MECO") of Pittsburgh, Pa. In conventional pickle lines wherein a two-high temper mills are similarly located, the temper mills merely serve as secondary scalebreakers as well as provide a certain degree of "shape correction" and "strip elongation." In addition to these known functions, the unique characteristics of temper mill 52 employed in the pickle line of the present invention offer the capability of controllable strip gauge correction or reduction. That is to say, the MECO two-high temper 52 mill is equipped with hydraulic roll bending cylinders 54 positioned generally about four feet laterally of the centerline of the mill housing 56 (FIG. 5A). A positive or convex bend or crown of up to about 0.013 inches can be induced in each of the two 38-inch work rolls 58 (FIG. 6A) by activating the roll bending cylinders 54 with up to two million pounds of hydraulic force axially applied to the ends of the work rolls. As will be appreciated by those skilled in the art, less hydraulic force applied by the roll bending cylinders 54 will result in a corresponding reduction in the crown induced in the work rolls 58. It is, however, the ability of the work rolls to be bent or crowned by cylinders 54 which affords temper mill 52 the capacity to precisely administer a desired measure of strip gauge reduction in addition to the scalebreaking, shape correction and strip elongation functions of other two-high temper mills currently used in conventional hot rolled coil processing lines. Although per se known in the art, it is the present inventor's understanding and belief that the MECO two-high temper mill 52 has heretofore been used solely in cut-to-length lines for working heavy gauge materials on the order of about 0.125 to 0.625 inches in thickness. It was not appreciated that such a mill could have meaningful utilitarian and economic advantage in pickle lines wherein the steel source product is of substantially thinner gauge.

Following treatment by temper mill 52, the strip thickness is then remeasured by an x-ray or similar gauge 59 after which it is engaged by a driven deflector pinch roll 60. Pinch roll 60 maintains tension in the strip upon exiting the temper mill and may be operated to selectively propel and direct the strip, as desired, to either a recoiler 62 (FIG. 6A) or further downstream toward the pickling zone of the strip treatment portion of the pickling line. Recoiler 62 is generally operated under conditions wherein strip of improper gauge may be recoiled by the recoiler and transported (once coiled) from the strip treatment line by a laterally translatable exit car 64 or similar means. When a strip is to be recoiled, a belt wrapper 65 (shown in phantom) is urged against the recoiler mandrel and forms the lead end of the downwardly deflected strip about the mandrel. Once the belt wrapper detects tension in the strip, i.e., that it is being positively recoiled by the recoiler 62, the belt wrapper is retracted. The recoiler 62 may also be activated to recoil strip purposely not intended to be pickled, or for reasons other than improper gauge is unsuitable for further processing. A further advantage arising from providing a recoiler at this stage of the strip treatment portion 46 is that strip can be selectively worked by temper mill 52 while downstream components of the strip treatment portion of the line undergo maintenance.

Should further processing be desired, the strip is directed by pinch roll 60 to pass along a first delivery table 66, through a side guide 68 and then an entry crop shear 72 for squaring the entry end of the strip in preparation for pickling. Any strip scrap sheared by the crop shear 72 falls into a scrap cart 74. While still under propulsion by pinch roll 60 the strip passes a second delivery table 76 and enters a cleaning station 78 shown in FIGS. 5B and 6B. Within the cleaning station, the strip is sprayed with a mist of cleaning solution such as a caustic 10% NaOH or KOH solution which is dispensed from a plurality of spray nozzles 80 serially arranged above and below the strip in the direction of strip travel.

Upon exiting the cleaning station, the strip then passes an entry wringer roll 82 of a first pickling tank in a series of such tanks which comprise the presently preferred configuration of the pickling zone. More particularly, the pickling zone includes a plurality, desirably three, pickling tanks of substantially similar construction and operation that are serially arranged in the direction of strip travel and which are illustrated in FIGS. 5B, 6B, 5C and 6C. The first pickling tank is identified by reference numeral 84, the second by reference numeral 86 and the third by reference numeral 88. Each tank is bounded at its entrance and exit by a wringer roll 82 to assure that the pickling liquor (described below) is substantially contained therewithin.

Figure 6B:
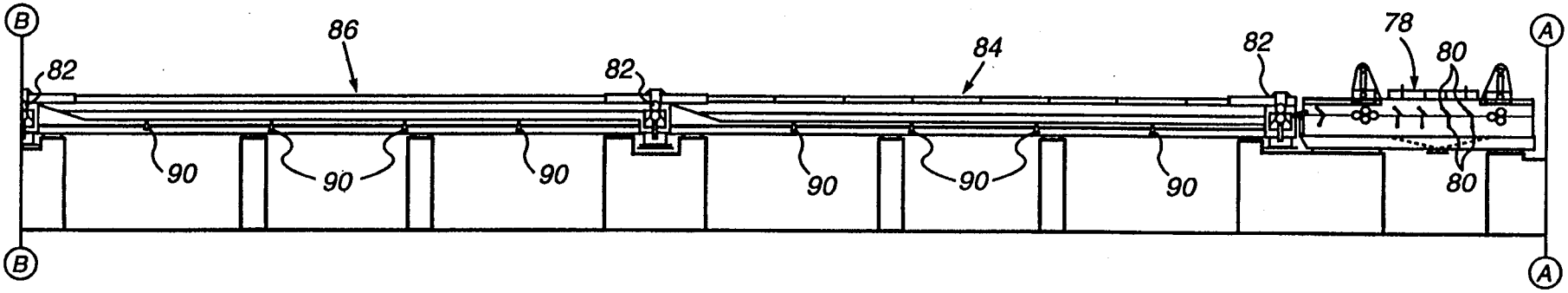
Figure 6C:
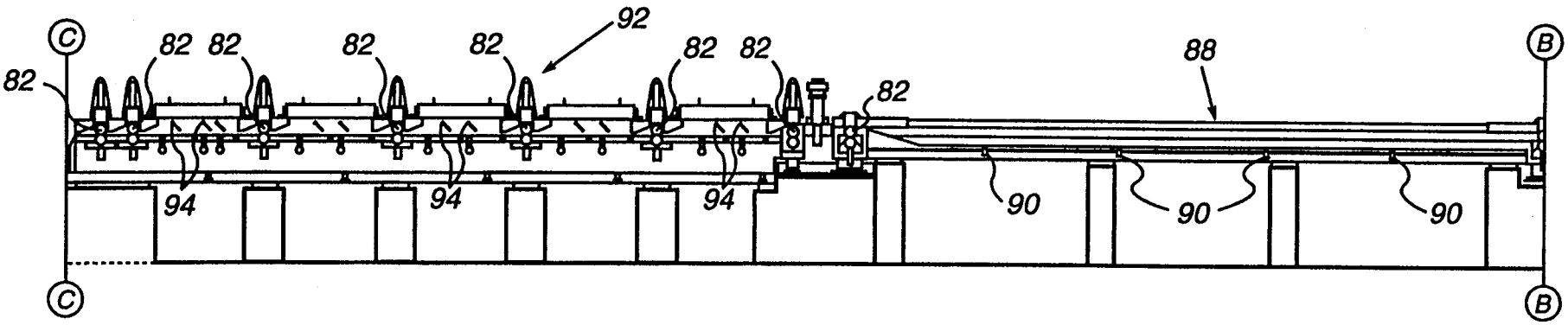

The semi-continuous (push-pull) pickle line utilizes a "turbo flow" hydrochloric acid pickling zone with an Inverted Laminar Sparging (ILS) system in each pickling tank 84, 86 and 88. In the preferred embodiment, each pickling tank is configured as a 47-foot long, shallow-bath (15 inch maximum), substantially V-shaped cross-section, granite lined tank. Hydrochloric acid is injected at about 800 gallons per minute per tank through sparging means comprising a plurality, preferably four, substantially laminar flow producing ports 90 located in the bottom of each tank (FIGS. 6B and 6C). The sparging means direct the acid upwardly and substantially vertically toward the bottom side of the strip in a substantially laminar flow. The flow of the acid coupled with velocity of the moving strip cooperate to aggressively scrub the relatively thickly scaled bottom surface of the strip and rapidly dissolve scale and oxide films residing thereon. The thinner and less developed oxide films at the strip top surface, on the other hand, require less forceful acid attack and are satisfactorily removed at essentially the same rate as the bottom surface scale via the usual turbulence created by a strip travelling through a pickling bath. Oxides can thus be removed at cost effective line speeds (i.e., up to 300 ft./min. or even greater) from both the bottom and the top surfaces of strips traditionally possessing difficult steel chemistries with respect to oxide formation and retention. In addition, the V-shaped cross-section of the pickle tanks in combination with the shallow bath depth assures vigorous recirculation and, therefore, optimum chemical utilization of the acid solution per unit volume thereof. Furthermore, the substantial reduction in both length and volume of the pickling tank produces tangible reductions in materials and energy consumption in relation to conventional pickling zones. Following pickling, the strip enters a rinsing station 92 comprising a flash pickle section and several stages of water dispensing nozzles 94 which direct counter current sprays or streams of rinse water at the strip.

Figure 5B:
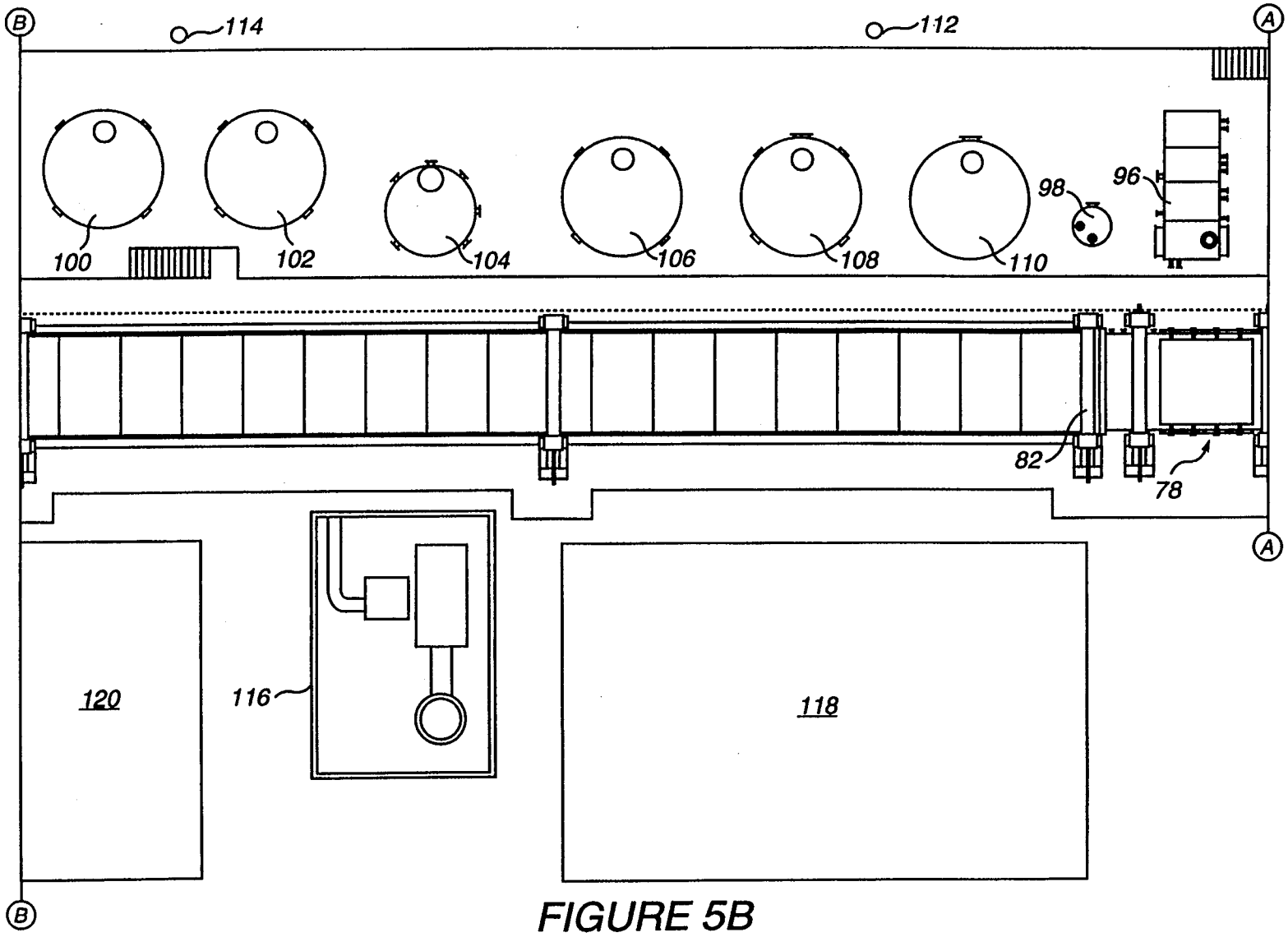
Figure 5C:
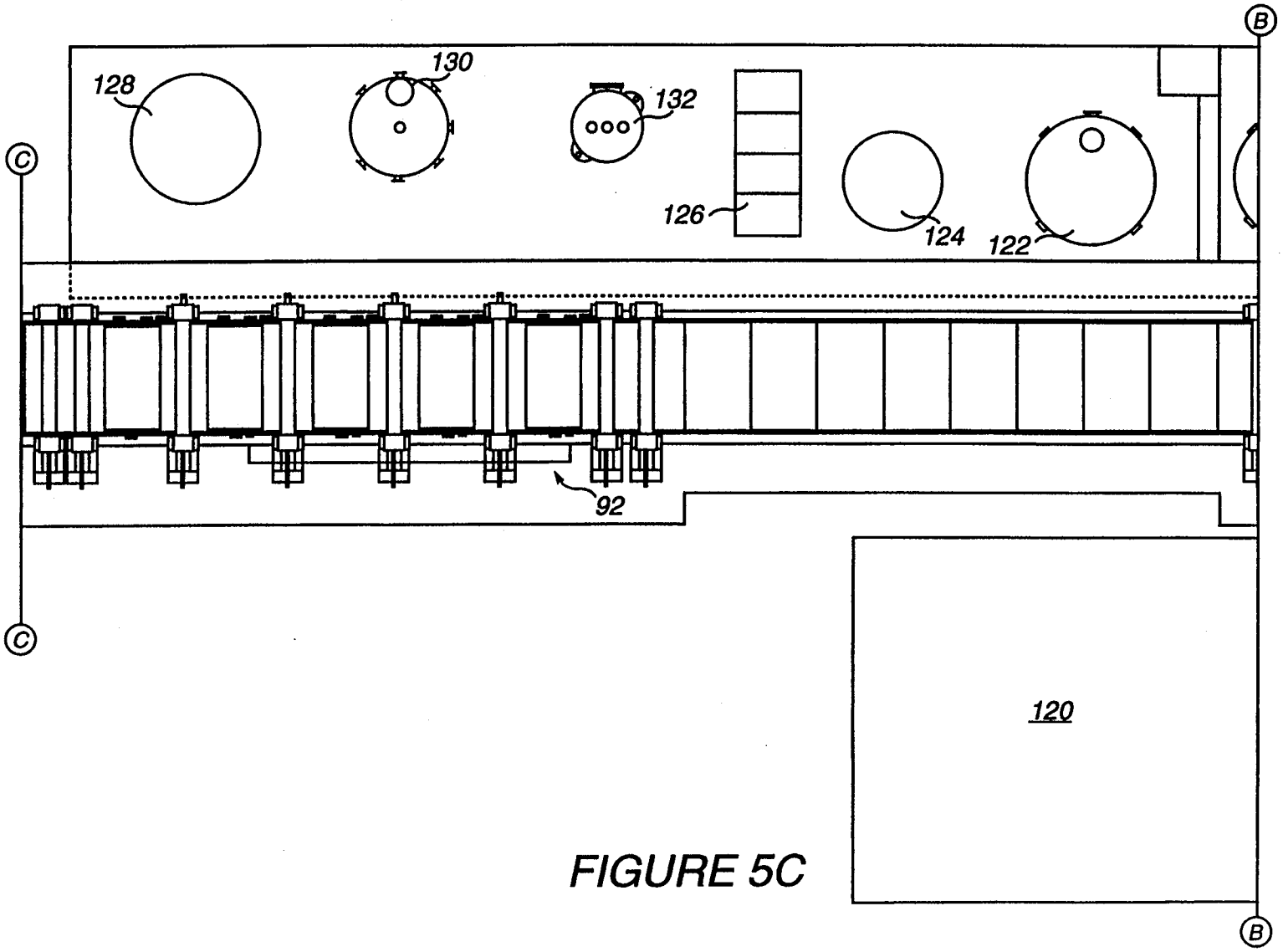

With further reference to FIGS. 5B and 5C, it will be seen that the strip treatment portion 46 includes various storage tanks for the cleaning solution, acid solution, spent pickling liquor, rinsing water and other materials that are required at various stages of the strip treatment process. For example, FIG. 5B illustrates a cleaning solution recirculation tank 96 and clean rinse tank 98 employed in the strip cleaning process occurring at the cleaning station 78. Likewise, that figure also depicts first and second fresh acid storage tanks 100 and 102, first and second acid recirculation tanks 104 and 106, and first and second spent pickling liquor tanks 108 and 110. A spent acid discharge station is identified by reference numeral 112 and an acid fill station by reference numeral 114. A fume emission control station is identified by numeral 116, a motor control room by numeral 118 and a boiler room by numeral 120. Also included, but not illustrated, are numerous operator stations including both manual and automated controls for such parameters as steel quality monitoring, acid bath pH and temperature control.

FIG. 5C illustrates the third acid recirculation tank 122. A buffer tank 124 and neutralizing tank 126 store suitable materials for controlling the pH of the waste water solution used in the rinsing station 92. A caustic material storage tank 128 is also shown, as are a water collection tank 130 and condensate tank 132 for use in operation of the rinsing station 92. For clarity of illustration, the necessary pumps conduits and related equipment for delivering water, acid, cleaning solution and other materials to and from the various stations in the strip treatment portion 46 of the steel strip pickling line are not illustrated as such equipment will be readily understood by the ordinarily skilled artisan and is not central to the invention.

Additionally, the dimensions, number and configurations of the pickling tanks in the pickling zone, as well as their operational characteristics, may be somewhat varied within the scope of the invention, as conditions dictate, to effect satisfactory pickling of steel for which the pickling zone is adapted for use.

Figure 5D:
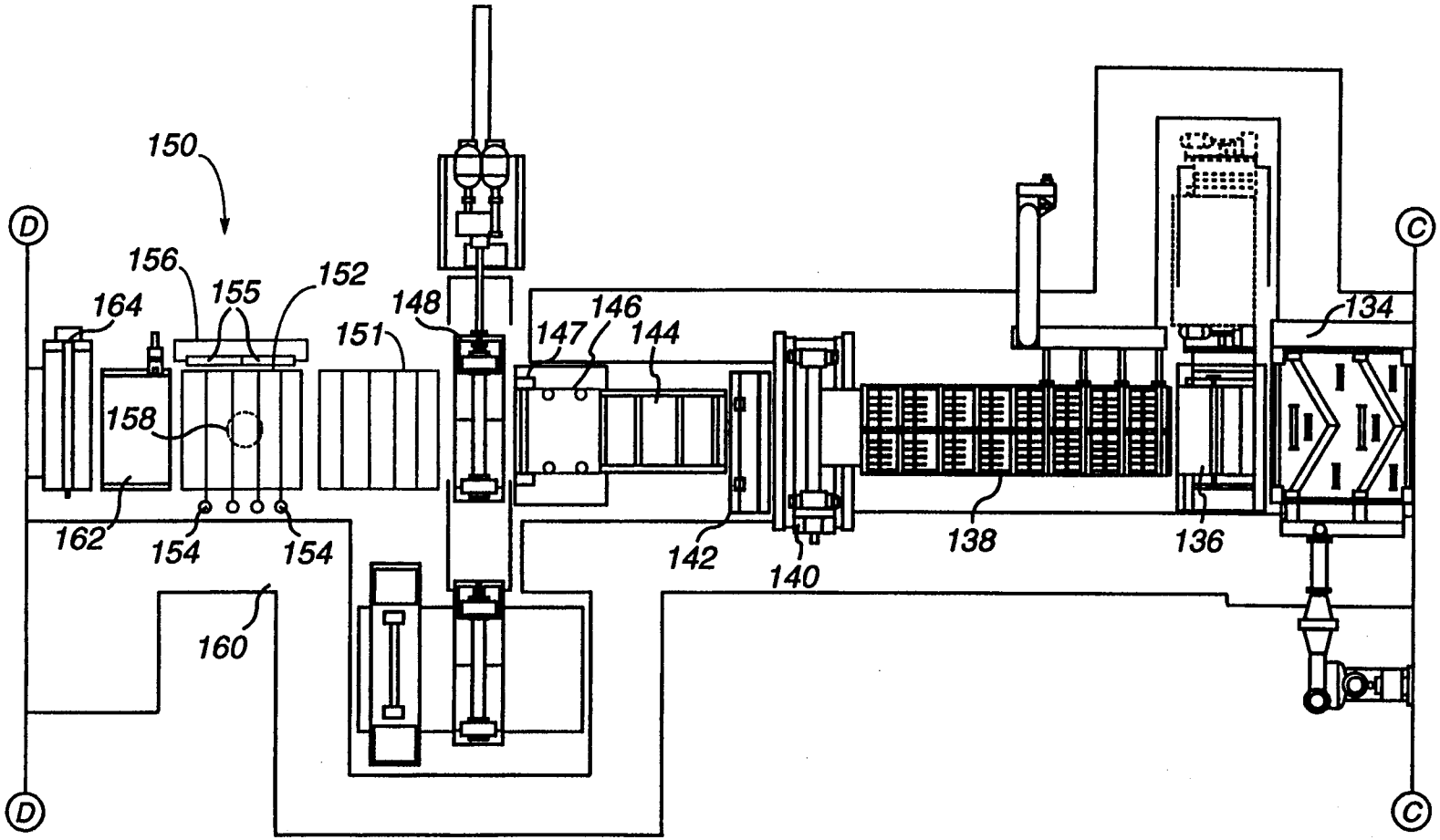
Figure 6D:
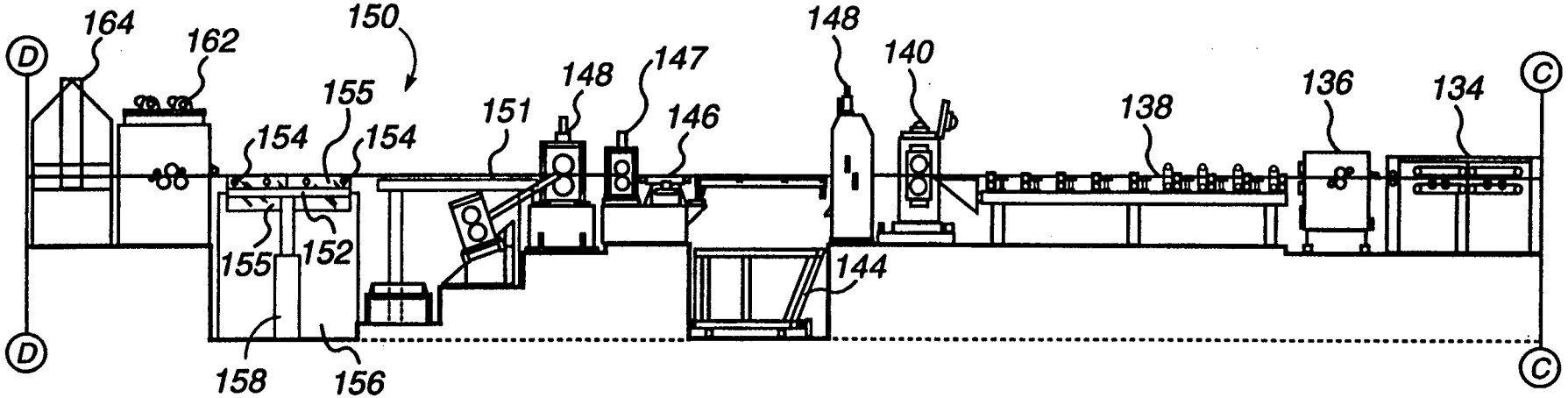

After the strip has been rinsed in rinsing station 92 it enters a strip dryer 134 shown in FIGS. 5D and 6D, which dryer may be of the hot air or equivalent type. The strip is then coated at a coating station 136, preferably with a dry lubricant such as GilCote® manufactured by Mangil Corp. of Cleveland, Ohio. Following coating at station 136 the strip passes over a dryer and carryover table 138 before entering a pinch roll 140 and exit resquare shear 142. Shear 142 is operable to square the trailing end of the pickled strip prior to recoiling. Scrap strip sheared by shear 142 falls into a scrap cart 144. Subsequent to passing shear 142 the strip enters side guides 146, preferably of the roller type, and, thereafter, a slitter pinch roll 147 and then an adjustable slitter/side trimmer 148. The slitter/side trimmer cuts the strip into accurate and uniform width while also enabling the strip, if desired or necessary, to be cut into two or more narrower strips suitable for coiling.

A run out table 150 follows the trimmer/slitter 148. The run out table includes an inspection table 152 carrying a battery of lights 154. Lights 154 preferably assume the form of high-intensity mercury arc spotlights, although illumination means of similar brightness would be acceptable. One or more mirrors 155 are pivotally supported on a stationary platform 156 situated generally opposite lights 154. Normally, the mirror(s) 155 are oriented at about 60° to the horizontal but may be adjusted according to the inspector's preference. The inspection table further comprises means 158 for adjusting the elevation of the table whereby the table may be sufficiently lowered as the strip passes thereover to expose the bottom surface of the strip to illumination by lights 154 and permit reflection of the bottom surface by mirrors 156. Adjusting means 158 may be extensible and retractable means such as, for example, motor driven scissor jacks, screw jacks, hydraulic or pneumatic cylinders or similar apparatus known in the art. So constructed, the run out table permits both strip surfaces to be simultaneously visually observed and quality inspected by the line operator/inspector as the strip passes an operating platform 160 (FIG. 5D). Under normal operation, the inspector activates the adjusting means 158 causing the inspection table 152 and lights 154 supported thereby to lower. The lowered inspection table then trips an unillustrated limit switch to turn on the lights. When inspection is completed, the table 152 may then be raised and the lights 154 turned off by the inspector utilizing suitable controls or, alternatively, by a sensor which detects the trailing end of the strip and transmits a signal to cause the adjusting means to raise the table and turn off the lights.

Subsequent to the run out table, the strip is engaged by a drag tension device 162 which propels the strip through an oiler station 164 preferably comprising an electronstatic oiler or other suitable oil applicator. The oiler station operates to coat both surfaces of the pickled strip with oil for lubrication and protection during storage and handling. Moreover, the oil composition is preferably selected to be one which is compatible with the lubrication system of the cold-mill reduction unit (not illustrated) within which the steel strip may be later processed.

The strip then progresses to a deflector pinch roll mechanism 165 that desirably includes an edge guide 166 and reel chute 168. The deflector pinch roll mechanism deflects the strip onto one of two mandrels 170 or 178 of an exit recoiler 172. The exit recoiler serves as the final component of the strip treatment portion 46 as well as the initial component of a coil delivery portion 174 of the push-pull pickle line of the present invention.

Figure 5E:
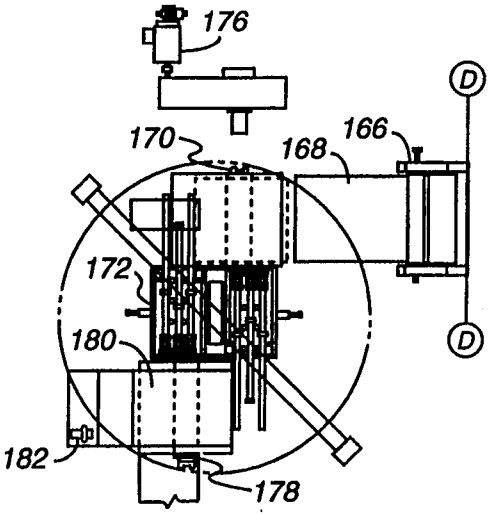
Figure 7:
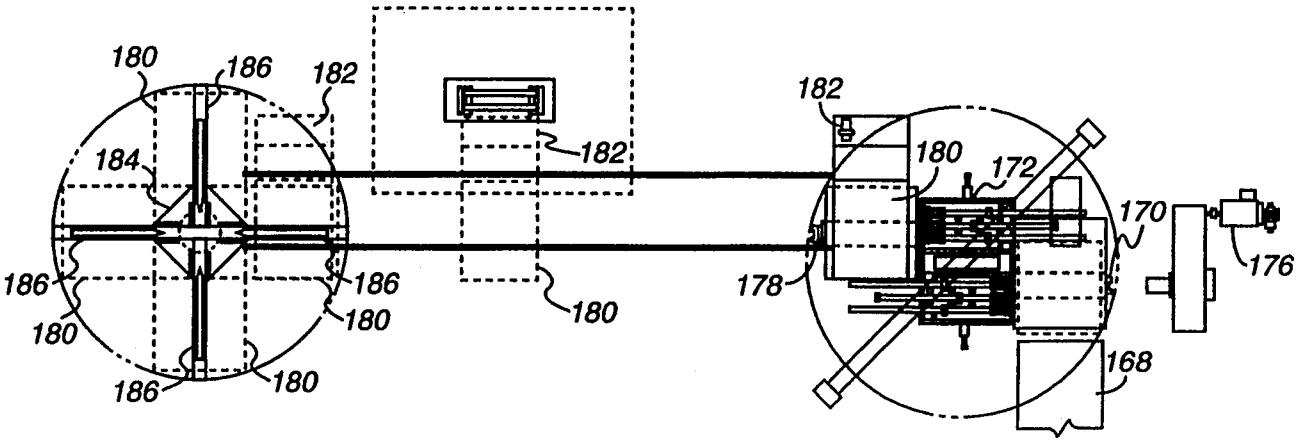
FIG. 7 is a plan view of the coil delivery portion of a pickle line constructed in accordance with the present invention.

The exit recoiler is driven by a motor 176. Preferably, the exit recoiler is configured as a dual mandrel turret recoiler, the second mandrel thereof being identified, as noted hereabove, by reference numeral 178. The recoiler 172 is thus capable of recoiling a first pickled strip about one mandrel thereof, e.g., first mandrel 170, then rotating 180° under propulsion of suitable unillustrated drive means to situate the strip coil into a discharge position while presenting the other mandrel, e.g., second mandrel 178, into position for recoiling a second length of pickled strip. The aforesaid discharge position is that of the second mandrel 178 in FIG. 5E. From the discharge position, the coiled strip 180 is delivered by a second motorized, reciprocable coil car 182 (shown in various locations in its course of travel in FIGS. 5E, 6E, and 7) to a multiple arm turnstile 184, the final component of the coil delivery portion 174. The turnstile according to the presently preferred embodiment possesses four radially directed coil support arms 186 each of which may receive a coil 180 from coil car 182. Once the coil is appropriately engaged by an arm 186, the turnstile may be turned to orient the coil such that it can be removed by a grapple or hook of a suitable coil lifting device (not shown) which may place the coil at a selected site. The operations of the exit recoiler 172, the second conveyor 182 and turnstile 184 are coordinated with one another, as well as with the coil entry and treatment portions of the pickle line, such that delivery efficiency of pickled coils may be optimized.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A pickle line operable to remove oxides from steel strip, said pickle line comprising:

a strip treatment portion including:

means for uncoiling steel strip from a coil of said strip;

means for pickling said strip in an acid solution to remove oxides therefrom;

means for enabling simultaneous visual inspection of the surface quality of opposite surfaces of said strip following pickling thereof; and means for recoiling said strip following inspection thereof.

2. The pickle line of claim 1 wherein said means for enabling simultaneous visual inspection comprise a table situated between said pickling means and said recoiling means and beneath a bottom surface of said strip as said strip passes from said pickling means to said recoiling means, and means for lowering said table to expose said bottom surface as said strip passes over said table.

3. The pickle line of claim 2 wherein said means for enabling simultaneous visual inspection further comprise means for reflecting said bottom surface as said strip passes over said table.

4. The pickle line of claim 3 wherein said means enabling simultaneous visual inspection further comprise means for illuminating said bottom surface as said strip passes over said table.

5. The pickle line of claim 1 further comprising temper mill means positioned between said uncoiling means and said pickling means for elongating, shape correcting and controllably reducing the gauge of said strip.

6. The pickle line of claim 5 wherein said temper mill means comprise a two-high temper mill including a pair of work rolls between which said strip passes and means for applying axial force to said work rolls to induce bending therein.

7. The pickle line of claim 1 further comprising a coil entry portion including a conveyor for conveying said coil of said strip to said uncoiling means.

8. The pickle line of claim 7 wherein said coil entry portion further includes a coil preparation station having means for examining at least one characteristic of said strip.

9. The pickle line of claim 1 wherein said recoiling means is a multiple mandrel recoiler capable of recoiling a length of said strip while delivering a recoiled strip to a discharge position.

10. The pickle line of claim 9 wherein said recoiling means is a dual mandrel recoiler.

11. The pickle line of claim 9 further comprising a coil delivery portion including a coil supporting turnstile and a reciprocable coil car for conveying said recoiled strip from said discharge position to said turnstile.

12. The pickle line of claim 11 wherein said turnstile includes a plurality of arms for receiving said recoiled strip.

13. The pickle line of claim 12 wherein said turnstile includes four arms for receiving said recoiled strip.

14. A pickle line operable to remove oxides from steel strip, said pickle line comprising:

a strip treatment portion including:

means for uncoiling steel strip from a coil of said strip;

means for pickling said strip in an acid solution to remove oxides therefrom, said pickling means comprising at least one pickling tank having sparging means in a lower region thereof for dispensing a substantially laminar flow of said acid solution substantially vertically toward a bottom surface of said strip as said strip passes through said at least one pickling tank; and means for recoiling said strip following pickling thereof.

15. The pickle line of claim 14 wherein said pickling means comprises a plurality of pickling tanks.

16. The pickle line of claim 14 wherein said pickling means comprise three pickling tanks.

17. The pickle line of claim 14 wherein said sparging means comprise at least one substantially laminar flow producing port.

18. The pickle line of claim 17 wherein said sparging means comprise a plurality of substantially laminar flow producing ports.

19. The pickle line of claim 17 wherein said sparging means comprise four substantially laminar flow producing ports.

20. The pickle line of claim 14 wherein said at least one pickle tank is substantially V-shaped in cross-section.

21. The pickle line of claim 20 wherein a bath of said acid solution in said at least one pickle tank is about 15 inches in depth.

22. The pickle line of claim 14 further comprising temper mill means positioned between said uncoiling means and said pickling means for elongating, shape correcting and controllably reducing the gauge of said strip.

23. The pickle line of claim 22 wherein said temper mill means comprise a two-high temper mill including a pair of work rolls between which said strip passes and means for applying axial force to said work rolls to induce bending therein.

24. The pickle line of claim 14 further comprising a coil entry portion including conveyor for conveying said coil or said strip to said uncoiling means.

25. The pickle line of claim 24 further wherein said coil entry portion further includes a coil preparation station having means for examining at least one characteristic of said strip.

26. The pickle line of claim 14 wherein said recoiling means is a multiple mandrel recoiler for recoiling a length of said strip while delivering a recoiled strip to a discharge position.

27. The pickle line of claim 26 wherein said recoiling means is a dual mandrel recoiler.

28. The pickle line of claim 26 further comprising a coil delivery portion including a coil supporting turnstile and a reciprocable coil car for conveying said recoiled strip from said discharge position to said turnstile.

29. The pickle line of claim 28 wherein said turnstile includes a plurality of arms for receiving said recoiled strip.

30. The pickle line of claim 29 wherein said turnstile includes four arms for receiving said recoiled strip.

31. A pickle line operable to remove oxides from steel strip, said pickle line comprising:

a strip treatment portion including:

means for uncoiling steel strip from a coil of said strip;

temper mill means for elongating, shape correcting and controllably reducing the gauge of said strip;

means following said temper mill means for pickling said strip in an acid solution to remove oxides therefrom, said pickling means comprising at least one pickling tank having sparging means in a lower region thereof for dispensing a substantially laminar flow of said acid solution substantially vertically toward a bottom surface of said strip as said strip passes through said at least one pickling tank;

means for enabling simultaneous visual inspection of the surface quality of opposite surfaces of said strip following pickling thereof; and means for recoiling said strip following inspection thereof.

32. A strip treatment system adapted for use in a pickle line having a pickling zone operable to remove oxides from steel strip, said system comprising:

means for uncoiling steel strip from a coil of said strip;

temper mill means for elongating, shape correcting and controllably reducing the gauge of said strip;

means following said temper mill means for recoiling said strip; and means situated between said temper mill means and said recoiling means for selectively directing said strip to either said pickling zone or said recoiling means.

33. A method of pickling steel strip to remove oxides therefrom, said method comprising the steps of:

(a) uncoiling steel strip from a coil of said strip;

(b) pickling said strip in an acid solution to remove oxides therefrom;

(c) simultaneously visually inspecting the surface quality of opposite surfaces of said strip following pickling thereof; and (d) recoiling said strip following inspection thereof.

34. A method of pickling steel strip to remove oxides therefrom, said method comprising the steps of:

(a) uncoiling said strip from a coil of said strip;

(b) pickling said strip in an acid solution to remove oxides therefrom, said pickling comprising dispensing a substantially laminar flow of said acid solution from at least one sparging port situated in a lower region of at least one pickling tank substantially vertically toward a bottom surface of said strip as said strip passes through said at least one pickling tank; and (c) recoiling said strip following pickling thereof.

35. A method of pickling steel strip to remove oxides therefrom, said method comprising the steps of:

(a) uncoiling said strip from a coil of said strip;

(b) elongating, shape correcting and controllably reducing the gauge of said strip in a temper mill;

(c) pickling said strip in an acid solution to remove oxides therefrom, said pickling comprising dispensing a substantially laminar flow of said acid solution from at least one sparging port situated in a lower region of at least one pickling tank substantially vertically toward a bottom surface of said strip as said strip passes through said at least one pickling tank;

(d) simultaneously visually inspecting the surface quality of opposite surfaces of said strip following pickling thereof; and (e) recoiling said strip following pickling thereof.

* * * * *